US012796816B2

(12) United States Patent
Wang

(10) Patent No.: US 12,796,816 B2
(45) Date of Patent: Nov. 17, 2026

(54) SWING MECHANISM AND ELECTRIC RECLINER

(71) Applicant: JIANGSU MULIN INTELLIGENCE ELECTRIC CO., LTD, Changzhou (CN)

(72) Inventor: Jianlong Wang, Changzhou (CN)

(73) Assignee: JIANGSU MULIN INTELLIGENCE ELECTRIC CO., LTD, Changzhou (CN)

( * ) Notice: Subject to any disclaimer, the term of this patent is extended or adjusted under 35 U.S.C. 154(b) by 90 days.

(21) Appl. No.: 19/006,403

(22) Filed: Dec. 31, 2024

(65) Prior Publication Data

US 2026/0069038 A1 Mar. 12, 2026

(30) Foreign Application Priority Data

Sep. 9, 2024 (CN) ..... 202422205494.9

(51) Int. Cl.
*A47C 3/025* (2006.01)
*A47C 1/02* (2006.01)

(52) U.S. Cl.
CPC ..... *A47C 3/0251* (2018.08); *A47C 1/02* (2013.01); *A47C 3/0255* (2013.01)

(58) Field of Classification Search
CPC ..... A47C 3/0251; A47C 3/0255
See application file for complete search history.

(56) References Cited

U.S. PATENT DOCUMENTS 4,536,029 A * 8/1985 Rogers, Jr. ..... A47C 3/0255 297/344.21
4,700,920 A * 10/1987 Horn ..... A47C 3/0255 248/370
5,653,505 A * 8/1997 Holobaugh, Jr. .... A47C 3/0255 297/273
5,931,530 A * 8/1999 Liu ..... A47C 3/0255 297/270.3 X
5,947,557 A 9/1999 Bellefleur
(Continued)

FOREIGN PATENT DOCUMENTS

CN 201055134 Y * 5/2008 ..... A47C 3/0255
CN 107157165 A * 9/2017 ..... A47C 7/002
(Continued)

*Primary Examiner* — Rodney B White
(74) *Attorney, Agent, or Firm* — Bayramoglu Law Offices LLC

(57) ABSTRACT

A swing mechanism and an electric recliner are provided. The swing mechanism includes: a pedestal; a swing support frame, located on the pedestal and including left and right support sheets, where both ends of an upper part of the left and right support sheets are respectively provided with a suspension point A and a suspension point B; two iron frame bearing frames, respectively located at outer sides of the left and right support sheets and each including a first rocking arm and a second rocking arm; and Upper ends of the first rocking arm and the second rocking arm are respectively hinged to the suspension point A and the suspension point B of the corresponding support sheet, and lower ends of the first rocking arm and the second rocking arm are respectively hinged to a hinging position C and a hinging position D of a corresponding bearing piece.

11 Claims, 11 Drawing Sheets

(56) References Cited

U.S. PATENT DOCUMENTS

| | | | | | |
|---|---|---|---|---|---|
| 6,120,094 | A * | 9/2000 | Parent | A47C 3/03 | 297/270.3 |
| 6,241,315 | B1 * | 6/2001 | Chiang | A47C 3/0255 | 297/258.1 |
| 6,244,658 | B1 * | 6/2001 | Parent | A47C 3/03 | 297/270.3 |
| 6,588,841 | B1 * | 7/2003 | Hoffman | A47C 3/0255 | 297/270.3 |
| 7,322,650 | B2 * | 1/2008 | Chouinard | A47C 3/0255 | 297/270.2 X |
| 7,334,840 | B2 * | 2/2008 | Deans | A47C 3/03 | 297/270.1 |
| 8,366,193 | B2 * | 2/2013 | Lin | A47C 3/0255 | 297/270.3 |
| 11,045,000 | B1 * | 6/2021 | Shih | A47C 3/0255 | |
| 12,161,225 | B2 * | 12/2024 | Li | A47C 1/0355 | |
| 12,364,336 | B2 * | 7/2025 | Zhao | A47C 1/0345 | |
| 2007/0007813 | A1 * | 1/2007 | Pomeroy | A47C 3/0255 | 297/440.1 |
| 2007/0096522 | A1 * | 5/2007 | Bergeron | A47C 3/03 | 297/270.1 |
| 2009/0189423 | A1 * | 7/2009 | Chi | A47C 7/52 | 297/217.3 |
| 2009/0189424 | A1 * | 7/2009 | Chi | A47C 7/72 | 297/217.4 |
| 2022/0361674 | A1 * | 11/2022 | Li | A47C 1/0355 | |
| 2024/0335041 | A1 * | 10/2024 | Webb | A47C 7/002 | |
| 2024/0341478 | A1 * | 10/2024 | Zhao | A47C 1/0345 | |
| 2026/0108068 | A1 * | 4/2026 | Xie | A47C 3/0251 | |

FOREIGN PATENT DOCUMENTS

| | | | | | |
|---|---|---|---|---|---|
| CN | 213431443 | U | | 6/2021 | |
| CN | 218355231 | U | | 1/2023 | |
| EP | 2151224 | A1 | * | 2/2010 | A47C 3/0255 |
| EP | 2151225 | A1 | * | 2/2010 | A47C 3/0255 |
| EP | 2151226 | A1 | * | 2/2010 | A47C 3/0255 |
| EP | 2189082 | A1 | * | 5/2010 | A47C 3/0255 |
| EP | 2189144 | A1 | * | 5/2010 | A47C 3/0255 |
| EP | 2266439 | A1 | * | 12/2010 | A47C 3/0255 |
| EP | 4501177 | A1 | * | 2/2025 | A47C 3/0255 |
| FR | 2825907 | A1 | | 12/2002 | |
| JP | 2001070075 | A | * | 3/2001 | A47C 3/0255 |
| KR | 20210000444 | U | | 2/2021 | |
| KR | 2025023860 | A | * | 2/2025 | A47C 3/0255 |
| WO | WO-9308716 | A1 | * | 5/1993 | A47C 3/0255 |
| WO | WO-2009128361 | A1 | * | 10/2009 | A47C 3/0255 |
| WO | WO-2009128362 | A1 | * | 10/2009 | A47C 3/0255 |
| WO | WO-2010150646 | A1 | * | 12/2010 | A47C 3/0251 |

* cited by examiner

SWING MECHANISM AND ELECTRIC RECLINER

CROSS REFERENCE TO THE RELATED APPLICATIONS

This application is based upon and claims priority to Chinese Patent Application No. 202422205494.9, filed on Sep. 9, 2024, the entire contents of which are incorporated herein by reference.

TECHNICAL FIELD

The present disclosure relates to the field of furniture and in particular to a swing mechanism and an electric recliner.

BACKGROUND

The swing mechanism of the existing electric recliners can drive the recliner iron frame to swing back and forth. But the swing mechanism is usually customized based on the recliner iron frame structure to be borne and therefore the swing mechanism is not universal and cannot adapt to the mounting requirements of different types of recliner iron frames. Even if some swing mechanisms can be compatible with multiple types of recliner iron frames, the swing mechanisms are relatively poor in coordination between back-forth swing amplitude and up-down fluctuation during swing process due to structural limitation of the swing mechanisms, making it difficult to realize stable swing.

In order to address the above technical issues, it is necessary to design a swing mechanism which can not only adapt to different types of recliner iron frames but also effectively coordinate the relationship between back-forth swing amplitude and up-down fluctuation in the swing process, thereby realizing stable swing effect.

It should be noted that the above information disclosed in the background is used only to help understand the background technology of the idea of the present disclosure and thus shall not be understood as the information of the prior arts.

SUMMARY

In order to address the above technical problems, the embodiments of the present disclosure at least provide a swing mechanism and an electric recliner.

An embodiment of the present disclosure provides a swing mechanism, including:

a pedestal;

a swing support frame, located on the pedestal and comprising left and right support sheets, where both ends of an upper part of the left and right support sheets are respectively provided with a suspension point A and a suspension point B;

two iron frame bearing frames, respectively located at outer sides of the left and right support sheets and each comprising a first rocking arm and a second rocking arm; where upper ends of the first rocking arm and the second rocking arm are respectively hinged to the suspension point A and the suspension point B of the corresponding support sheet, and lower ends of the first rocking arm and the second rocking arm are respectively hinged to a hinging position C and a hinging position D of a corresponding bearing piece; and, at least one first iron frame connection position at a side of the hinging position C away from a leg side of an iron frame is disposed on the bearing pieces, and at least one second iron frame connection position at a side of the hinging position D facing toward a back side of the iron frame is disposed on the bearing pieces.

The present disclosure has the following beneficial effects: in the swing mechanism and the electric recliner, an approximate inverted trapezoidal structure is formed by the suspension point A, the suspension point B, the hinging position C and the hinging position D to realize limitation on the back-forth swing distance and the up-down fluctuation distance. When an iron frame is mounted on the swing mechanism, the support positions, for example, support ends, at the bottom of the iron frame left and right sheets can correspond to the iron frame connection positions on the bearing pieces, so as to improve the mounting compatibility of the iron frame, achieving the same swing effect with different iron frames.

Additional features and advantages of the present disclosure will be described in the following specification, and some of these will become apparent from the specification or be understood through the practice of the present disclosure. The objectives and other advantages of the present disclosure are achieved and obtained through the structures specifically outlined in the specification, claims, and accompanying drawings.

To make the above objects, features, and advantages of the present disclosure clearer and more understandable, the present disclosure will be described in detail below with reference to the preferred embodiments and accompanying drawings.

BRIEF DESCRIPTION OF THE DRAWINGS

In order to more clearly describe the technical solutions in the specific embodiments of the present disclosure or in the prior arts, the drawings required for descriptions of the specific embodiments or prior arts will be briefly introduced below. Apparently, the drawings described hereunder are some embodiments of the present disclosure. Those skilled in the arts can also obtain other drawings based on these drawings without carrying out creative work.

Figure 1:
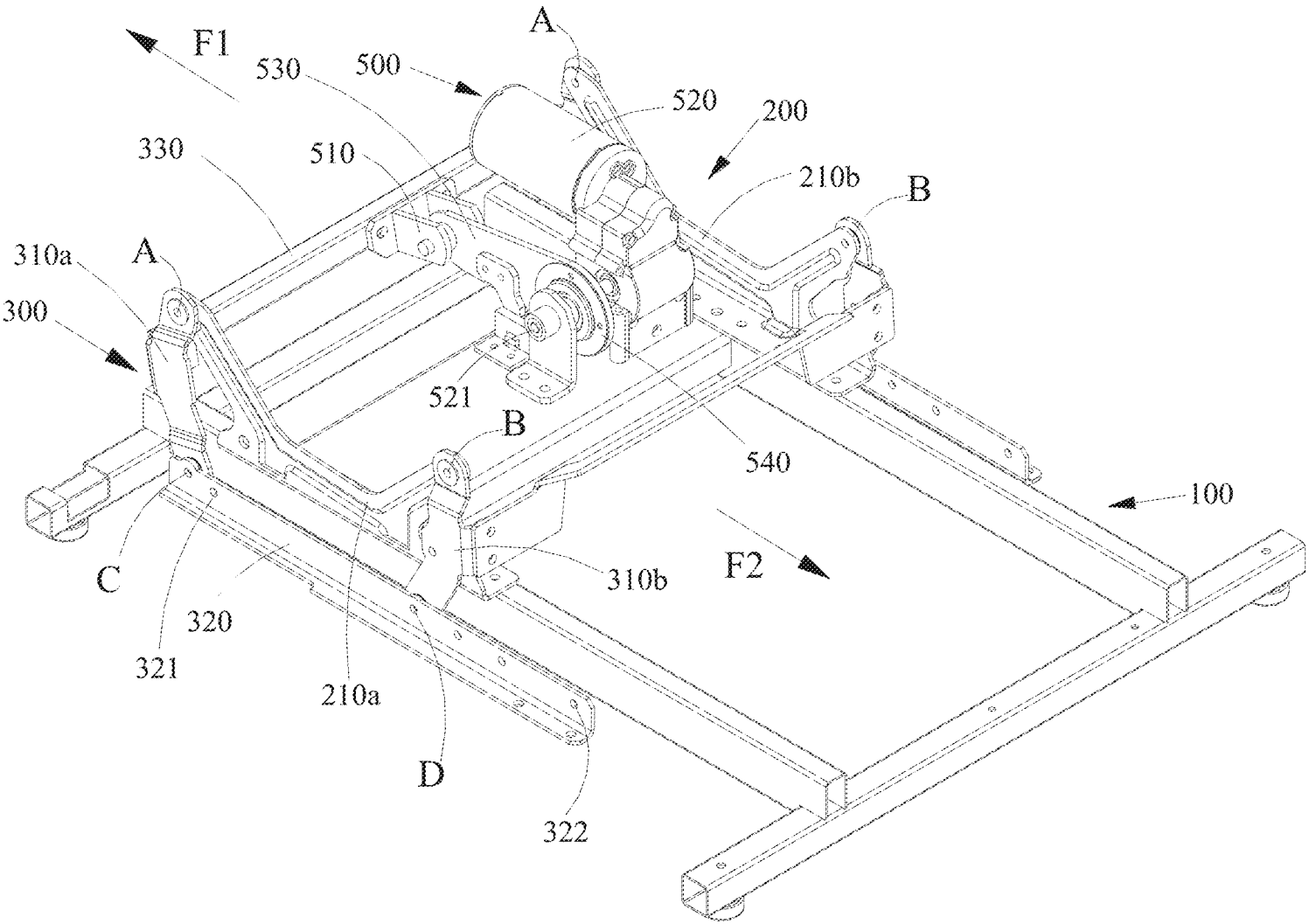
FIG. 1 is a structural schematic diagram illustrating a swing mechanism according to an embodiment of the present disclosure.

Numerals of the drawings are described below:

pedestal 100; swing support frame 200, left support sheet 210*a*, right support sheet 210*b*, suspension point A, suspension point B; iron frame bearing frame 300, first rocking arm 310*a*, second rocking arm 310*b*, bearing piece 320, first iron frame connection position 321, second iron frame connection position 322, drive cross arm 330, hinging position C, hinging position D; iron frame left sheet 400*a*, iron frame right sheet 400*b*; drive mechanism 500, linear driver 501, hinging piece 510, drive motor 520, drive motor output shaft 521, crank arm 530, eccentric wheel 540, rotary bearing 550.

DETAILED DESCRIPTION OF THE EMBODIMENTS

In order to make the object, technical solutions and advantages of the embodiments of the present disclosure clearer, the technical solutions of the present disclosure will be fully and clearly described in combination with drawings. Apparently, the embodiments described herein are only some embodiments rather than all embodiments. All other embodiments obtained by those skilled in the art based on these embodiments without making creative work shall fall within the scope of protection of the present disclosure.

The terms used herein are used only to describe specific exemplary configurations without any purpose of limitation. As used herein, the articles "a", "an" and "the" in singular forms can also be intended to include plural forms unless otherwise indicated clearly. The terms "include", "contain" and "have" are inclusive and therefore the presence of the specified features, steps, operations, elements and/or components does not preclude presence or addition of one or more other features, steps, operations, elements, components and/or their combinations. The method steps, processes and operations described herein shall not be interpreted as requiring them to be performed in the discussed or indicated specific sequence, unless otherwise marked as execution sequence. Additional or alternative steps may be used.

As used herein, the phrases "in one embodiment", "according to one embodiment", "in some embodiments" and the like usually refer to the fact that the specific features, structures or characteristics following the phrases can be included in at least one embodiment of the present disclosure. Therefore, the specific features, structures or characteristics can be included in more than one embodiment of the present disclosure such that these phrases do not necessarily refer to the same embodiment. As used herein, the terms "example", "illustrative" and the like are used as examples, instances or descriptions. Any implementations, aspects or designs described as "examples" or "exemplary" herein are not necessarily interpreted as preferred or superior to other implementations, aspects or designs. On the contrary, the terms "examples" and "exemplary" and the like are used to present concepts with specific manners.

The swing mechanisms of the electric recliners bring the iron frames to swing back and forth. But the current swing mechanisms are usually exclusively designed based on the structures of the iron frames to be borne and thus the swing mechanisms are not universal, and cannot bear multiple types of iron frame structures. Even if the swing mechanisms can be compatible with multiple types of iron frames, the swing mechanisms are relatively poor in coordination between back-forth swing amplitude and up-down fluctuation distance during swing process due to structural limitation of the swing mechanisms, making it difficult to realize stable swing.

Therefore, in order to address the above technical issues, it is necessary to design a swing mechanism which can not only adapt to different types of recliner iron frames but also effectively coordinate the relationship between back-forth swing amplitude and up-down fluctuation in the swing process, thereby realizing stable swing effect.

In this embodiment, an approximate inverted-trapezoidal structure is constructed by using a suspension point A, a suspension point B, a hinging position C and a hinging position D, so as to realize limitation for a back-forth swing distance and a up-down fluctuation distance. When an iron frame is mounted to the swing mechanism, bottom support positions of iron frame left and right sheets, for example, support ends, can correspond to iron frame connection positions of bearing pieces, so as to improve the mounting compatibility of the iron frame and hence achieve consistent swing effect in spite of being mounted to different types of iron frames.

It should be noted that similar numerals and letters in the following drawings refer to similar items, and therefore, once one item is defined in one drawing, there is no need to define and interpret it further in the subsequent drawings. Therefore, in the drawings, in order to effectively describe the technical contents, the thicknesses of the parts can be overstated or understated.

Some embodiments of the present disclosure will be detailed below in combination with the drawings. In case of no conflicts, the following embodiments and the features in the embodiments can be mutually combined.

Figure 2:
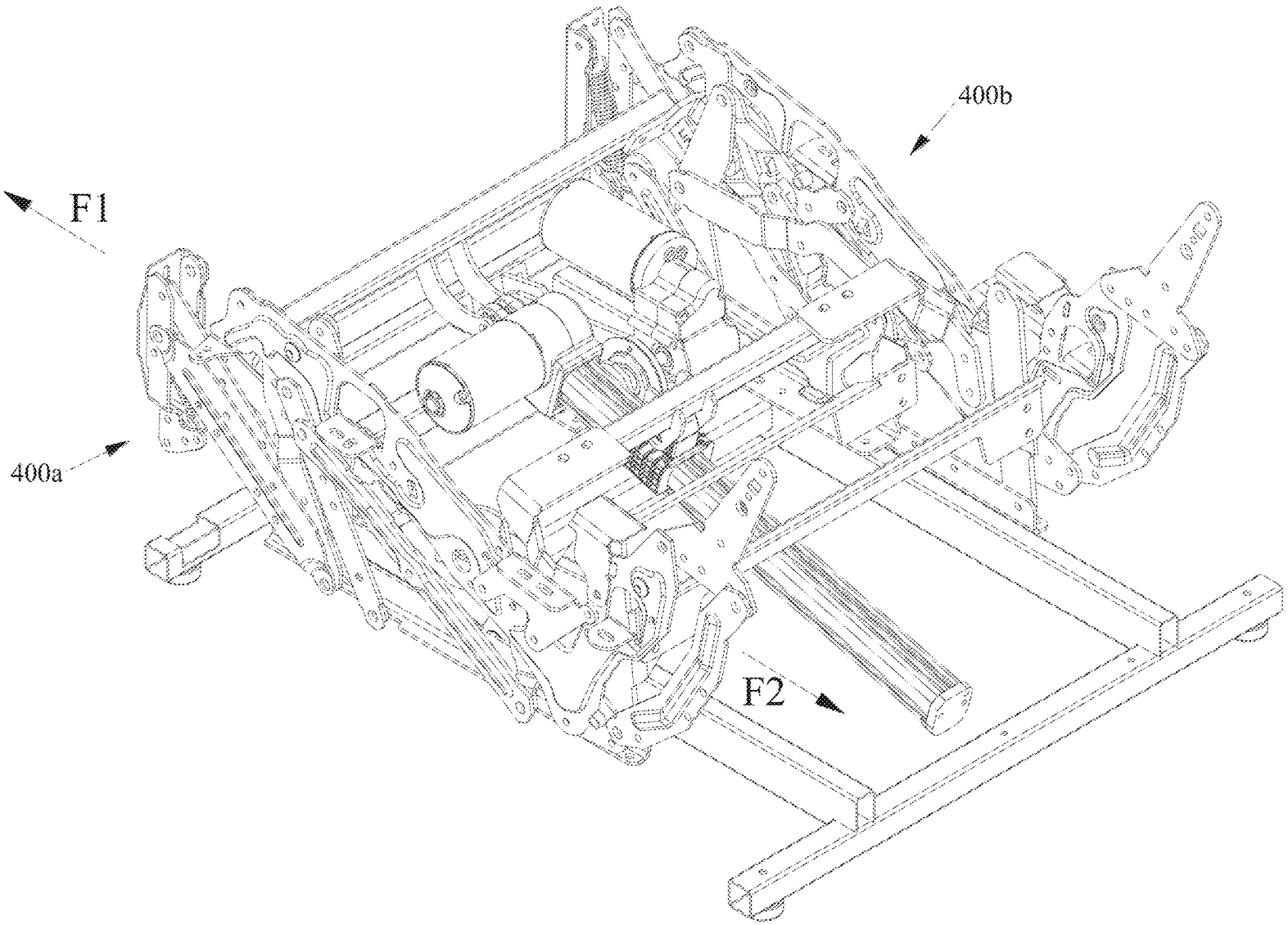
FIG. 2 is a stereoscopic schematic diagram illustrating a swing mechanism with an iron frame mounted according to an embodiment of the present disclosure.
Figure 3:
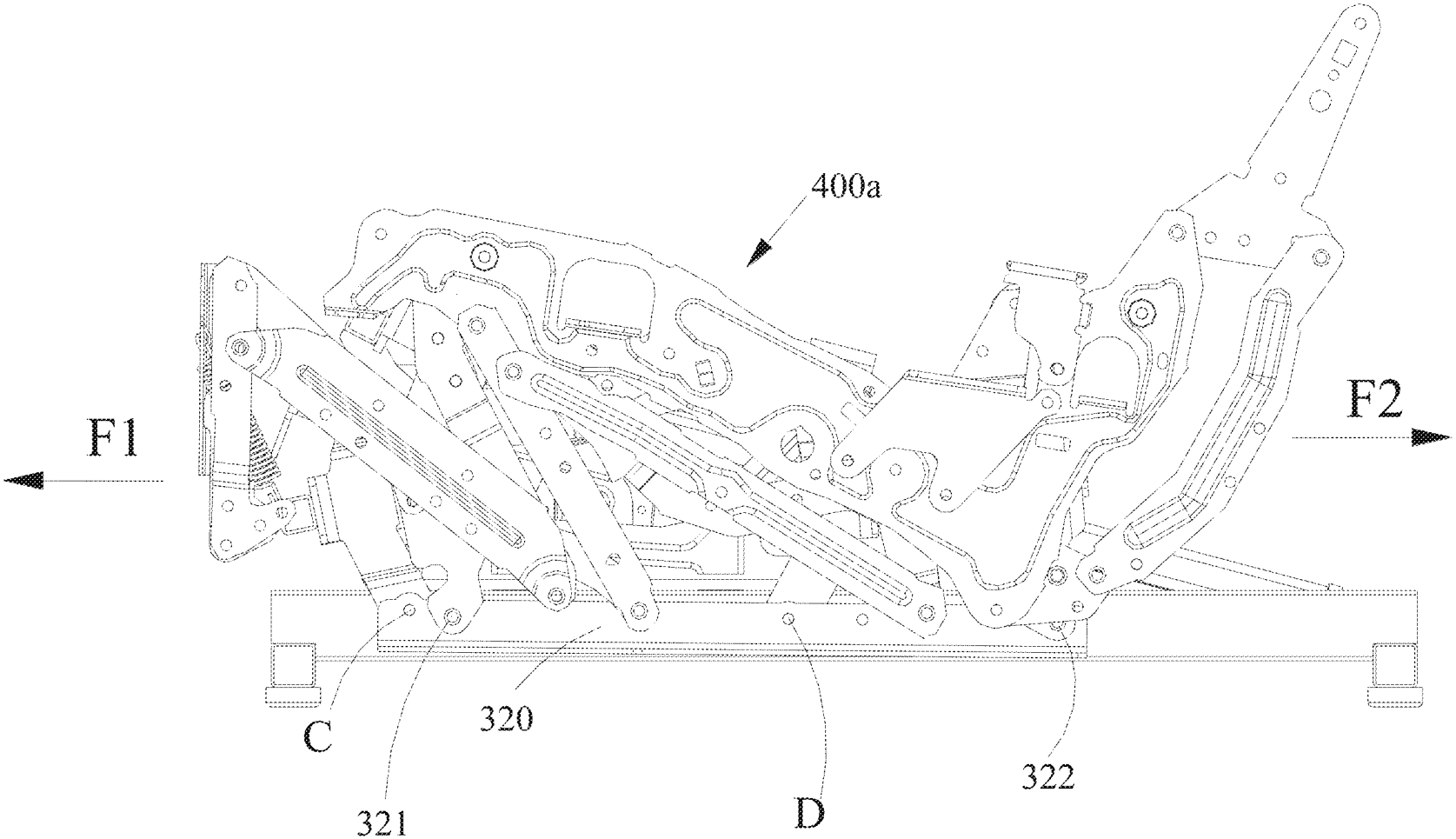
FIG. 3 is a side view illustrating a swing mechanism with an iron frame mounted according to an embodiment of the present disclosure.

As shown in FIGS. 1 to 3, in order to better display an assembling relationship between a swing mechanism and a recliner iron frame, a specific assembling structure is shown in FIGS. 2 and 3. Specifically, in order to solve the above technical problems, at least one embodiment of a swing mechanism is provided. As shown in FIG. 1, it shows a structural schematic diagram illustrating a swing mechanism according to an embodiment of the present disclosure. The swing mechanism may include: a pedestal 100, a swing support frame 200, a left support sheet 210*a*, a right support sheet 210*b*, suspension points A, suspension points B, and two iron frame bearing frames 300 respectively disposed corresponding to the left support sheet 210*a* and the right support sheet 210*b*. Each of the iron frame bearing frames 300 includes a first rocking arm 310*a*, a second rocking arm 310*b*, a bearing piece 320, a hinging position C and a hinging position D. In order to better reflect the assembling relationship between the swing mechanism and the recliner iron frame, FIGS. 2 and 3 are provided, where the arrow F1 represents a leg direction and the arrow F2 represents a back direction. A first iron frame connection position 321 and a second iron frame connection position 322 bearing an iron frame left sheet 400*a* and a first iron frame connection position 321 and a second iron frame connection position 322 bearing an iron frame right sheet 400*b* are provided. The iron frame left sheets 400*a* and the iron frame right sheet 400*b* are symmetrically mounted on the bearing pieces 320 to form an entire structure of the recliner iron frame. From FIG. 1, it can be seen that the swing support frame 200 is located on the pedestal 100 and includes the left support sheet 210*a* and the right support sheet 210*b*. Both ends of an upper part of the left support sheet 210*a* and the right support sheet 210*b* are provided with the suspension point A and the suspension point B. The two iron frame bearing frames 300 are respectively disposed at outer sides of the left support sheet 210*a* and the right support sheet 210*b*, and each include the first rocking arm 310*a* and the second rocking arm 310*b*. Upper ends of the first rocking arm 310*a* and the second rocking arm 310*b* are respectively hinged to the suspension point A and the suspension point B of the corresponding support sheet, and lower ends of the first rocking arm 310*a* and the second rocking arm 310*b* are respectively hinged to the hinging position C and the hinging position D of the corresponding bearing piece 320. From FIG. 3, it can be seen that at least one first iron frame connection position 321 at a side of the hinging position C away from the leg side of the iron frame is disposed on the bearing pieces 320, and at least one second iron frame connection position 322 at a side of the hinging position D facing toward the back side of the iron frame is disposed on the bearing pieces 320.

In some embodiments, in a practical use process, because a long reserved space is provided at a side of the hinging position C away from the leg side of the iron frame and at a side of the hinging position D facing toward the back side of the iron frame respectively on the bearing pieces 320, different models of iron frame left sheet 400*a* and iron frame right sheet 400*b* can be mounted based on actual requirements to form a complete recliner iron frame structure.

As shown in FIG. 1, the suspension point A, the suspension point B, the hinging position C and the hinging position D all together form an approximate inverted trapezoid, and the corresponding bearing piece 320 is located at a lower part of the inverted trapezoid. The two bearing pieces 320 each bear an iron frame left sheet 400*a* and an iron frame right sheet 400*b*. In some embodiments, in order to ensure the stable swing brought about by the deformation of the inverted trapezoid in swing process, the structure of the inverted trapezoid and the swing process are defined with corresponding parameters below.

Figure 4:
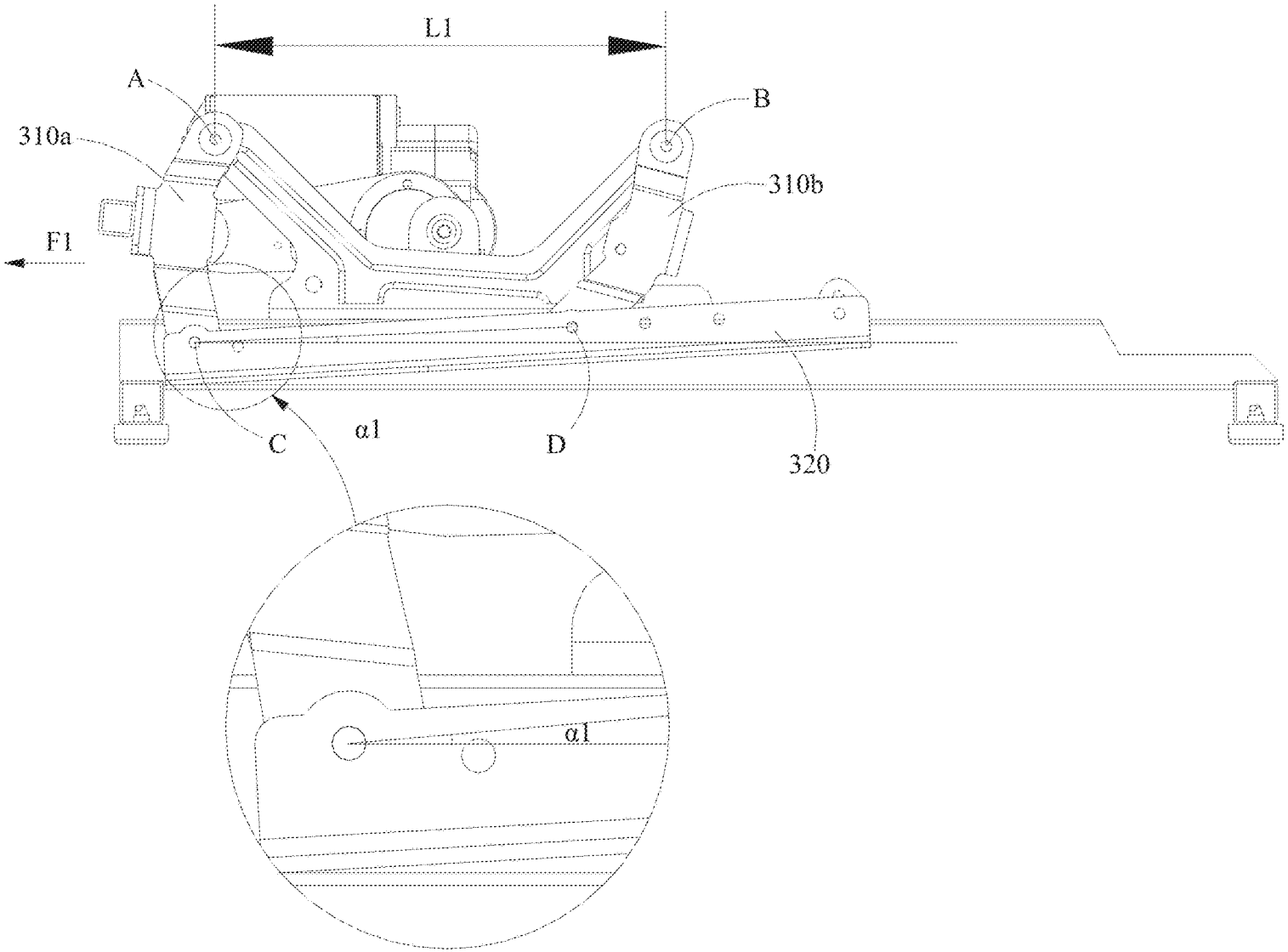
FIG. 4 is a structural side view 1 illustrating a swing mechanism moving toward a leg side according to an embodiment of the present disclosure.
Figure 6:
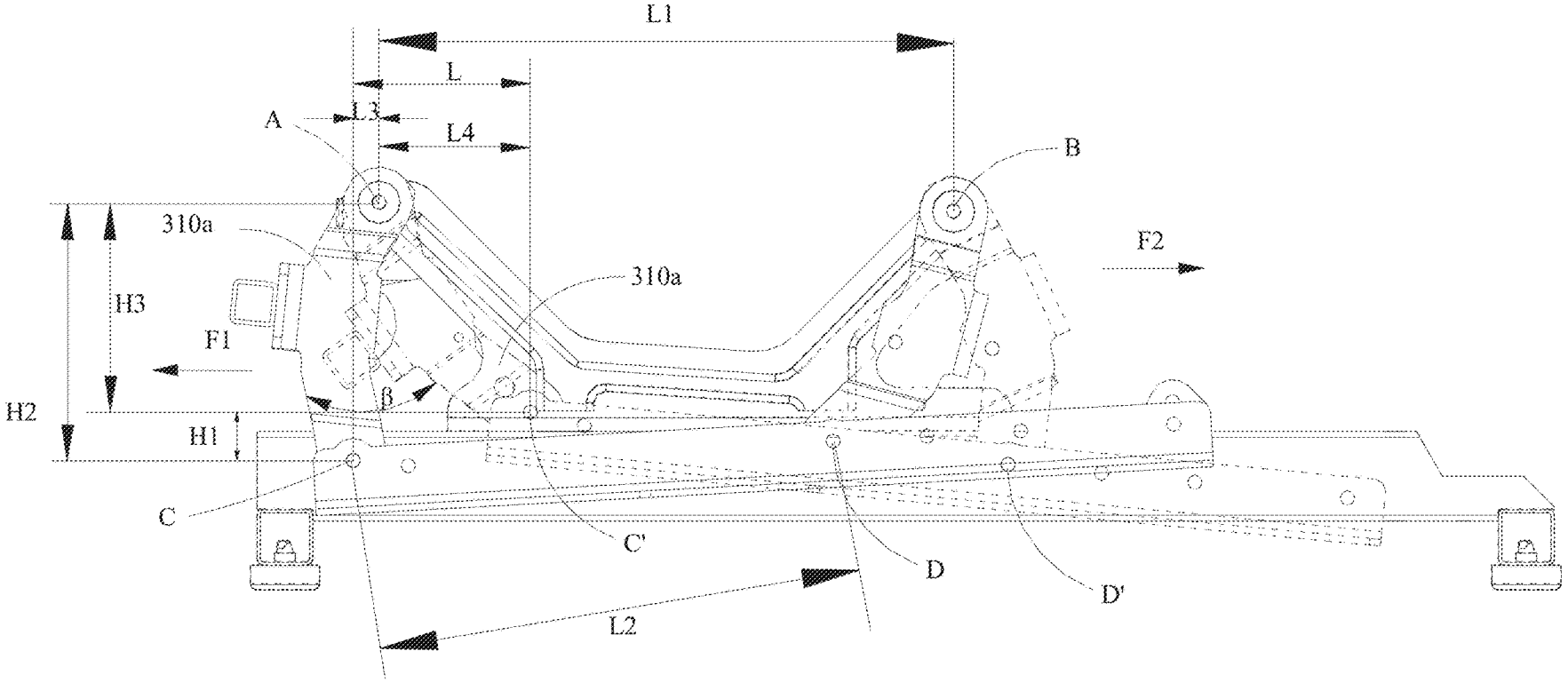
FIG. 6 is a schematic diagram illustrating a swing process of a swing mechanism according to an embodiment of the present disclosure.

FIG. 4 is a schematic diagram illustrating a swing of a swing mechanism along the direction F1, and FIG. 6 is a schematic diagram illustrating a swing of a swing mechanism along the directions F1 and F2, where the F1 direction is represented by a solid line, the F2 direction is represented by a dotted line, and a swing angle of the first rocking arm 310*a* is represented by B.

As shown in FIGS. 4 and 6, the swing angle β of the first rocking arm 310*a* is limited between 10° and 55°, preferably, between 25° and 50° and specifically may be 28°, 34°, 45° or 48°. A straight line distance between the suspension point A and the suspension point B is L1, and a straight line distance between the hinging position C and the hinging position D is L2, where L1:L2=(12 to 13):(10 to 12). The above value may be a ratio which may be adjusted based on actual situations. Specifically, in order to satisfy the above constraint condition, the L1 may be limited between 240 mm and 260 mm and the L2 may be limited between 200 mm and 240 mm. By limitation on the upper and lower distances and the swing angle β of the first rocking arm 310*a*, better control can be performed on the entire swing deformation of the inverted trapezoidal structure, so as to obtain a more stable swing state.

Figure 5:
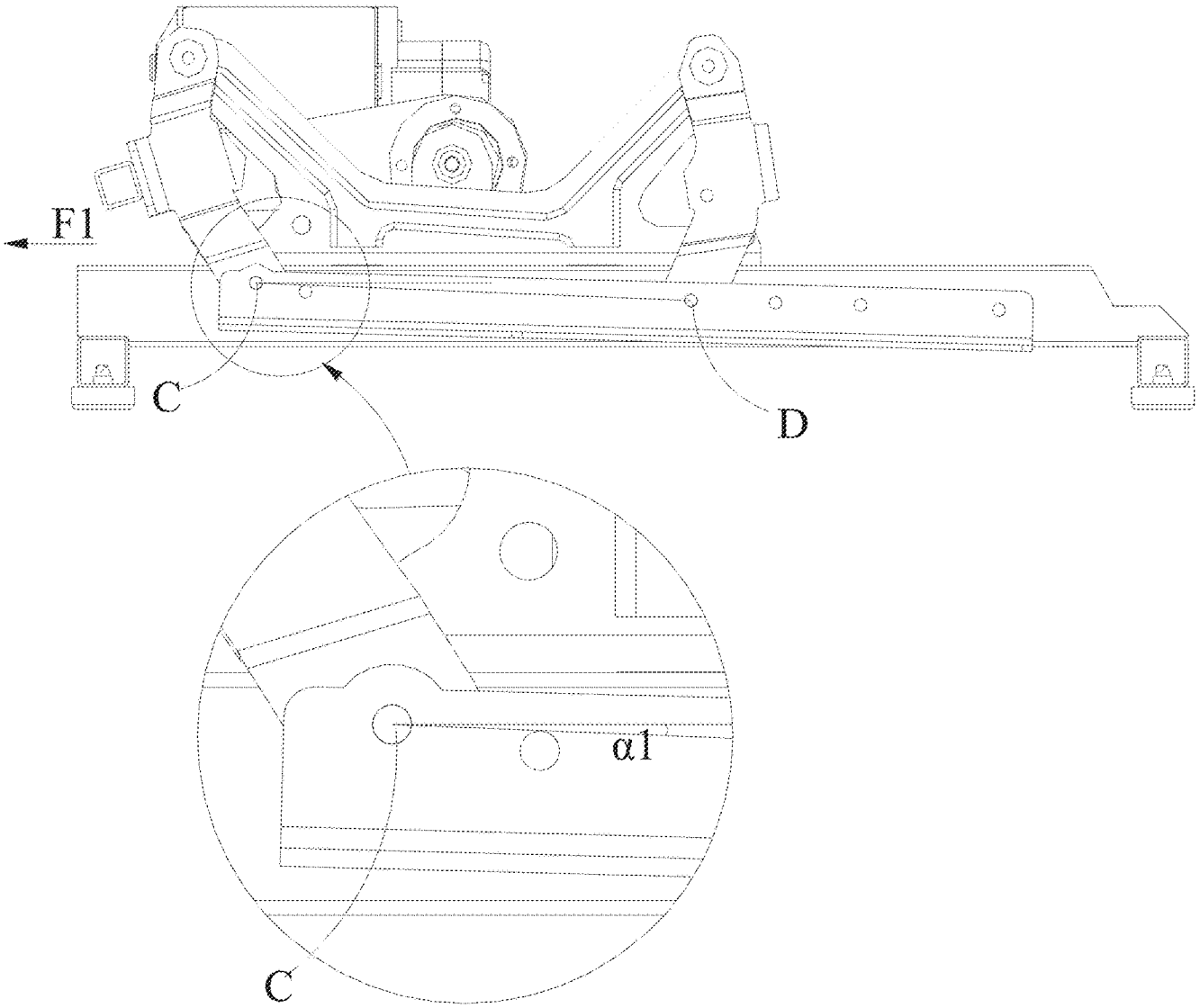
FIG. 5 is a structural side view 2 illustrating a swing mechanism moving toward a leg side according to an embodiment of the present disclosure.
Figure 7:
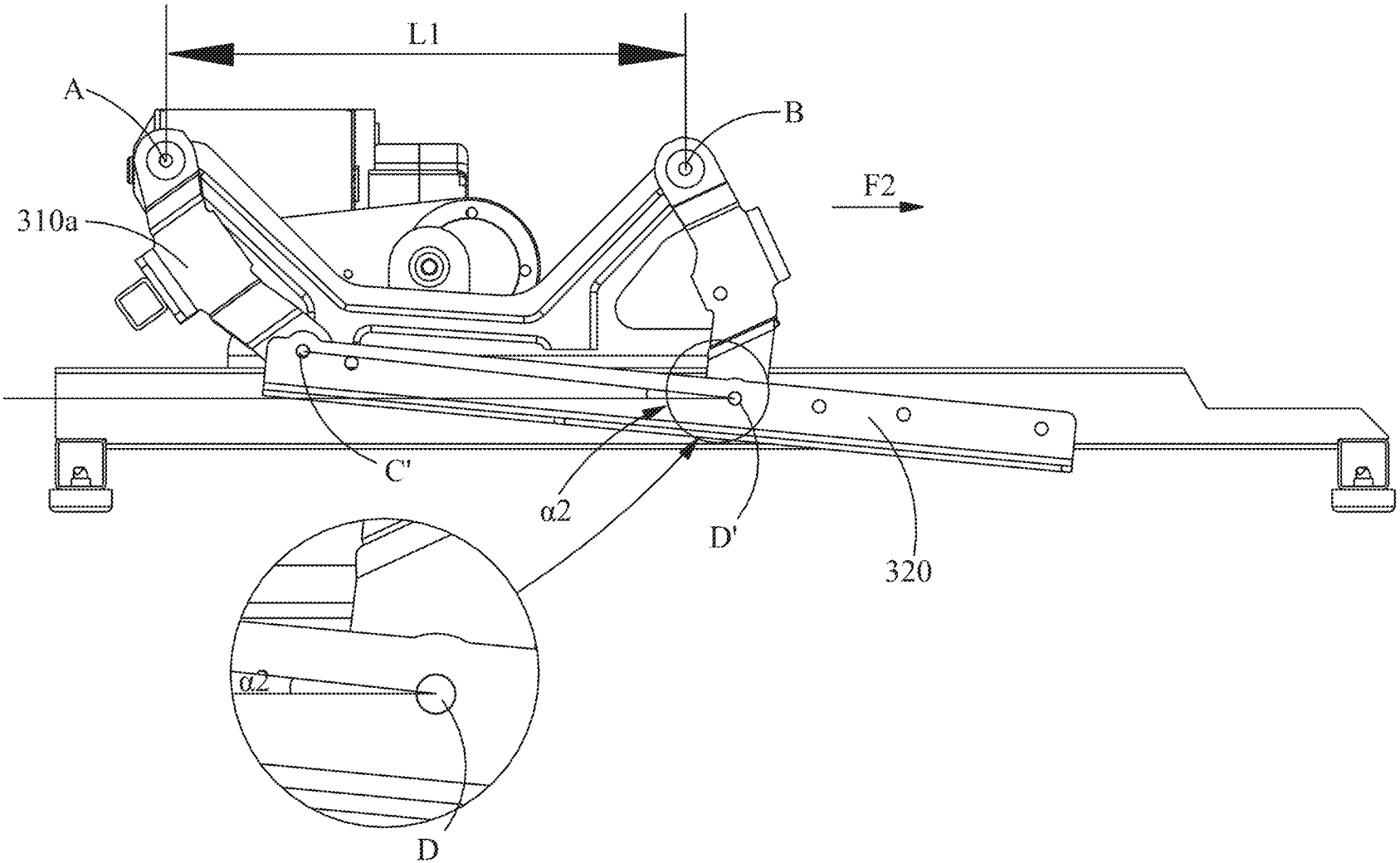
FIG. 7 is a schematic diagram illustrating a swing process of a swing mechanism moving toward a back side according to an embodiment of the present disclosure.

As shown in FIGS. 4 and 5, when the bearing piece 320 swings, the first rocking arm 310*a* swings toward the leg side of the iron frame (along the direction shown by the arrow F1); when the first rocking arm 310*a* swings to a maximum amplitude toward the leg side of the iron frame, a maximum included angle between a line connecting the hinging position C and the hinging position D and a horizontal plane is α1, where the α1 in FIG. 4 is above the horizontal line and defined as a positive value; and the α1 in FIG. 5 is below the horizontal line and defined as a negative value. As shown in FIGS. 6 and 7, the first rocking arm 310*a* swings toward the back side of the iron frame (along the direction shown by the arrow F2), and the hinging position C and the hinging position D are moved, with the action relationship continuing from FIG. 6 to FIG. 7. When the first rocking arm 310*a* swings to a maximum amplitude toward the back side of the iron frame, a maximum included angle between a line connecting the hinging position C' and the hinging position D' and the horizontal line is α2. When the angle α2 is above the horizontal line, the angle can be defined as positive value. The relationship of α1, α2 and L2 is α1:α2:L2=(1° to −4°):(2° to 6°):(200 mm to 240 mm). The α1 and α2 open in opposite directions. The α1 and α2 can be converted into a pitch angle of a sitting position of a person in a swing process. With the limitation of the above parameters, when a person sits, the person can have a better pitch angle and can at least have the comfort brought by one or more positions of sitting position, TV position and lying position of the recliner iron frame.

With reference to FIG. 6, the straight line distance between the suspension point A and the suspension point B is L1, the straight line distance between the hinging position C and the hinging position D is L2 and L1:L2=(240 to 260):(200 to 240); with reference to FIGS. 3 and 4, when the bearing piece swings, a height difference of a highest level and a lowest level of the hinging position C is H1; the L1:L2:H1=(240 to 260):(200 to 240):(2 to 25). With the limitation of the above parameters, when a person sits, the up-down height in swing process can be controlled such that the person can have smoother swing experience and hence at least have the comfort brought about by one or more of sitting position, TV position and lying position of the recliner iron frame.

With continuous reference to FIG. 6, the straight line distance between the suspension point A and the suspension point B is L1, the straight line distance between the hinging position C and the hinging position D is L2, and L1:L2=(240 to 260):(200 to 240); a back-forth swing value at the time of swing of the bearing piece is L, which specifically is a horizontal distance between the hinging position C at the time of swinging to the maximum amplitude toward the leg side by the first rocking arm 310*a* and the hinging position C' at the time of swinging to the maximum amplitude toward the back side by the first rocking arm 310*a*. The relationship of L1, L2 and Lis L1:L2:L=(240 to 260):(200 to 240):(8 to 85). The back-forth swing value L corresponds to a back-forth distance of the iron frame in swing process. In some embodiments, By limiting the distances of L1 and/or L2 and/or L, the back-forth swing amplitude can be limited such that the person can have smoother swing experience, and hence at least have the comfort brought about by one or more of sitting position, TV position and lying position of the recliner iron frame. For example, the hinging point C is moved forward to shorten the length of the L2 while the swing amplitude of the Lis adjusted to smaller, achieving smoother swing.

Figure 8:
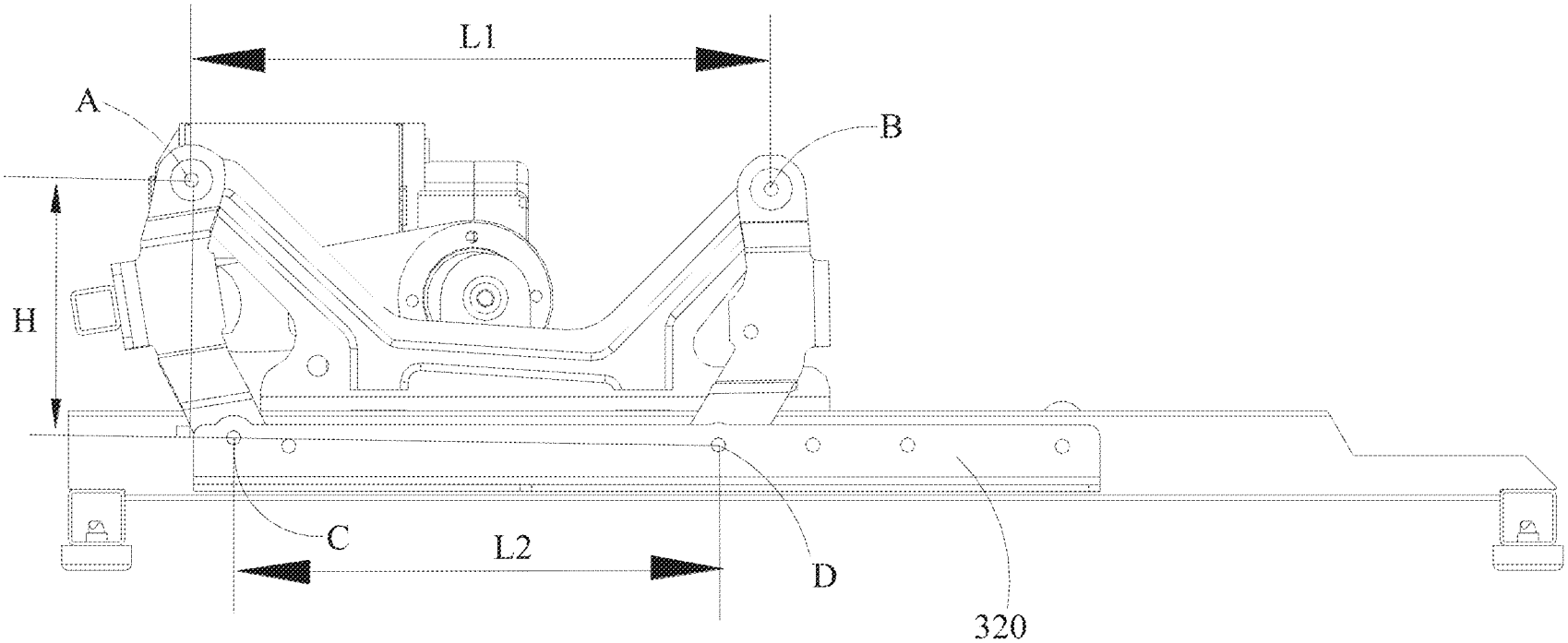
FIG. 8 is a structural schematic diagram illustrating a swing mechanism in a natural suspension state according to an embodiment of the present disclosure.

With reference to FIG. 8, the straight line distance between the suspension point A and the suspension point B is L1, and the straight line distance between the hinging position C and the hinging position D is L2; the suspension point A is approximate in height to the suspension point B; and when the bearing piece is in a natural suspension state, the suspension point A and the suspension point B are approximately in a horizontal state, and a line CD connecting the hinging point C and the hinging point D is made, and a vertical distance between the suspension point A and the line CD is H; L1:L2:H=(240 to 260):(200 to 240):(83 to 120). The above H value determines the height of the bearing pieces. In practical use, a ground clearance of the iron frame during swing process is α1 so limited. Illustratively, when the bearing piece 320 is in a natural suspension state, the vertical distance H may be 90 mm, 112 mm or 120 mm. Along with the swing of the bearing piece 320, the vertical distance H changes. In order to satisfy the height between the recliner body and the ground and ensure the height of the seat, the value of the H at the time of the bearing piece 320 being in a natural suspension state is extremely crucial.

Figure 9:
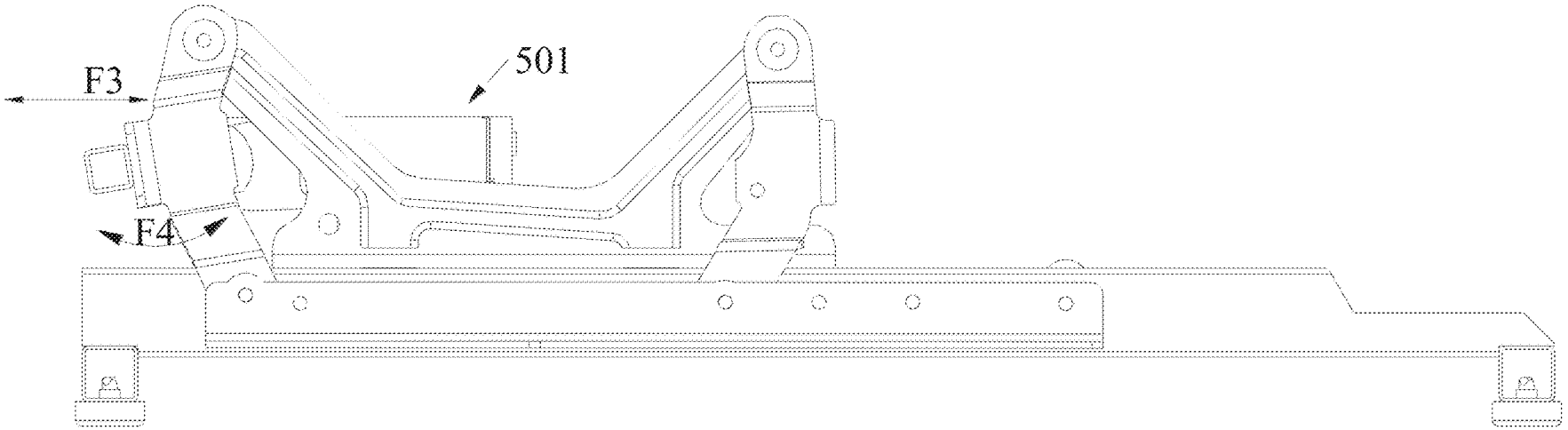
FIG. 9 is a structural schematic diagram illustrating a swing mechanism driven under a linear driver according to an embodiment of the present disclosure.

With reference to FIGS. 1 and 9, in some embodiments, the swing mechanism may include a drive mechanism 500 with its drive end hinged to a drive cross arm 330 disposed between the two iron frame bearing frames to drive the bearing pieces to swing. Illustratively, the first rocking arm 310*a* can serve as a drive arm through the drive cross arm 330 and the second rocking arm 310*b* can serve as a driven arm. Of course, in some embodiments, the second rocking arm 310*b* serves as the drive arm and the drive cross arm 330 serves as a driven arm.

correlated with a swing amplitude of the swing support frame. By limiting the eccentric distance of the eccentric wheel 540 (specific parameter limitation of the eccentric distance is shown in Table below), the swing amplitude of the bearing pieces 320 can be adjusted to satisfy the mounting and swing requirements of different types of electric recliner iron frames. Specifically, the suspension point A, the suspension point B, the hinging position C and the hinging position D form an approximate inverted trapezoid, and under the drive of the crank arm 530, the bearing pieces 320 bearing the recliner iron frame perform cyclic swing along an elliptical trajectory, as shown in FIGS. 3 to 7.

Figure 10:
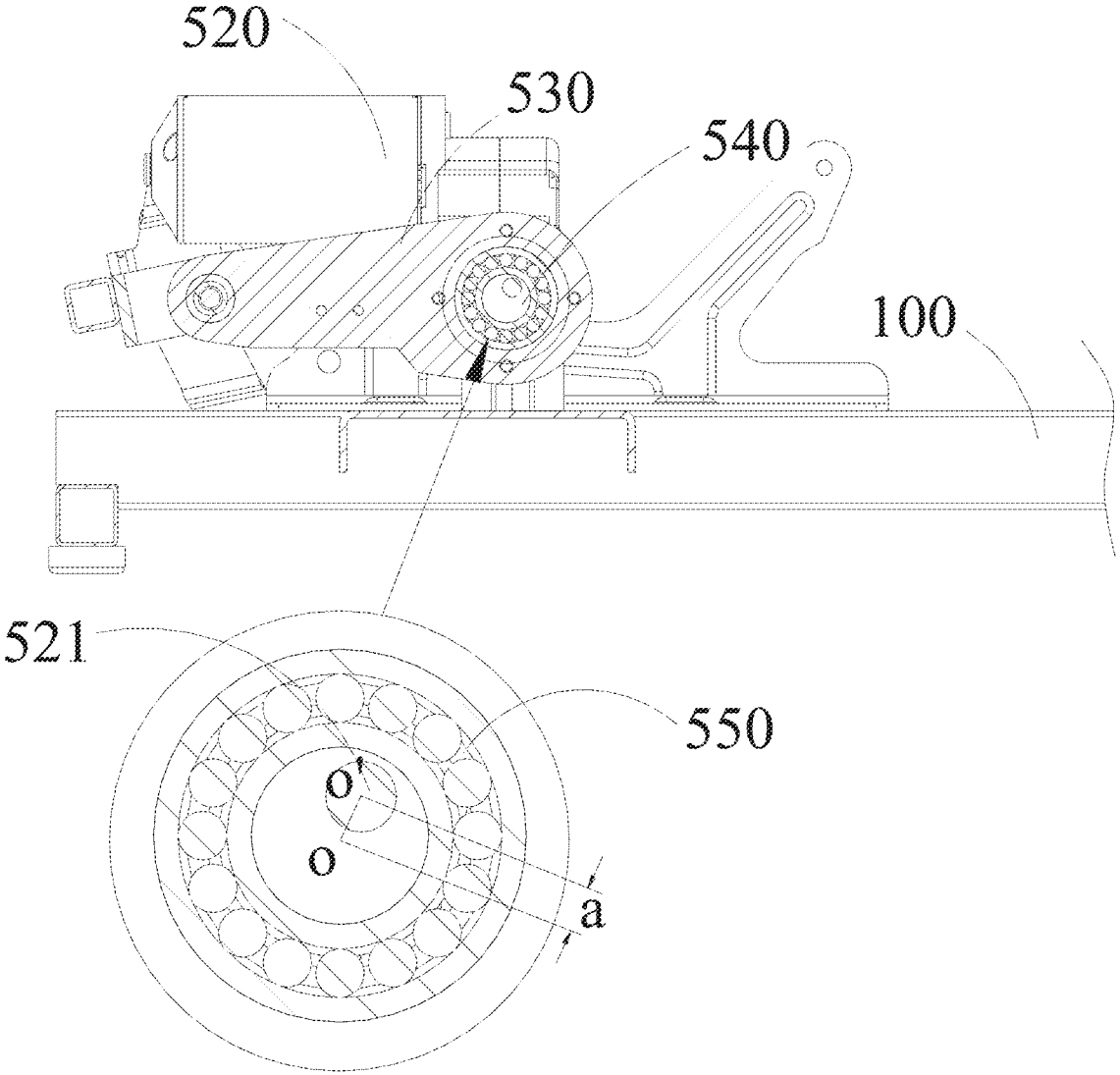
FIG. 10 is a structural and partially-enlarged view illustrating a swing mechanism with an eccentric wheel according to an embodiment of the present disclosure.

With reference to FIGS. 6 and 10, the implementation of the above eccentric wheel 540 is specifically reflected in the following: the eccentric distance a is a distance between an axis center O of the rotary bearing 550 and an axis center O' of a drive motor output shaft 521; a rotary bearing 550 can be disposed inside the eccentric wheel 540 in a concentric way; when the bearing pieces swing, the height difference of the highest level and the lowest level of the hinging position C in the bearing pieces is H1; a:H1=1:(1 to 2).

With reference to FIGS. 6 and 10, in some embodiments, there is the eccentric distance a; when the bearing pieces swing, the back-forth swing value of the hinging position C is L; a:L=1:(3 to 5).

For example, in a case of different eccentric distances, the corresponding values H1 and L are shown in Table below:

| Eccentric distance a (mm) | H1(mm) | H2(mm) | H3(mm) | L(mm) | L3(mm) | L4(mm) |
|---|---|---|---|---|---|---|
| 2.5 | 2.52 | 113.72 | 111.2 | 9.9 | 23.65 | 33.55 |
| 5 | 5.04 | 114.64 | 109.6 | 19.8 | 18.67 | 38.47 |
| 7.5 | 7.6 | 115.35 | 107.75 | 29.7 | 13.67 | 43.37 |
| 10 | 10.18 | 115.83 | 105.65 | 39.62 | 8.65 | 48.27 |
| 12.5 | 12.82 | 116.1 | 103.28 | 49.56 | 3.6 | 53.16 |
| 15 | 15.53 | 116.14 | 100.61 | 59.52 | (−1.47) | 58.05 |
| 17.5 | 18.36 | 115.97 | 97.61 | 69.51 | (−6.56) | 62.95 |
| 20 | 21.32 | 115.57 | 94.25 | 79.55 | (−11.67) | 67.88 |

With reference to FIG. 1, as an optional connection manner of the drive mechanism, the drive cross arm 330 is disposed between the first rocking arms 310*a* of the two iron frame bearing frames 300, and a hinging piece 510 is disposed between the drive cross arm 330 and the drive end.

In FIG. 1, it shows a structural schematic diagram illustrating an implementation of a drive motor 520, a crank arm 530 and an eccentric wheel 540. Of course, it can be realized by another implementation. FIG. 1 is only a schematic diagram illustrating an implementation of the drive mode. Therefore, it does not mean that the swing mechanism necessarily uses the above implementation of the drive motor 520, the crank arm 530 and the eccentric wheel 540.

As shown in FIG. 9, for example, a linear driver 501 is provided, an extension end of the linear driver 501 serves as a drive end, and the extension end of the linear driver 501 is also hinged to the drive cross arm 330; a telescoping distance of the linear driver 501 is such that the swing angle of the first rocking arm 310*a* is 10° to 55°. Specifically, the telescoping mode of the linear driver 501 is as shown by the arrow F3 in FIG. 9 and the first rocking arm swings as shown by the arrow F4.

With reference to FIGS. 1 and 10, with the eccentric wheel as an example, some working modes of this embodiment will be set forth below. In some embodiments, an eccentric distance of the eccentric wheel 540 is positively In the above table, H2 is a height difference of the point C moving to the lowest point and the point A in FIG. 6, and H3 is a height difference of the point C moving to the highest point, e.g. point C' and the point A in FIG. 6; the height difference H1=H2−H3.

L3 is a horizontal moving distance of the hinging position C moving to the extreme of the leg side in the direction F1 relative to the vertical line of the suspension point A in FIG. 6, and L4 is a horizontal moving distance of the hinging position C moving to the extreme, e.g. point C', of the back side in the direction F2 relative to the vertical line of the suspension point A. In the Table, when the hinging point is located on the right side of the vertical line of the suspension point A, the L3 is a positive value, for example, the value 23.65 to 3.6 in the Table, and when the hinging point is located on the left side of the vertical line of the suspension point A, the L3 is a negative value, for example, the value −1.47 to −11.67. In FIG. 6, for example, the hinging point is on the left side of the vertical line of the suspension point A, and the distance difference between the L3 and L4 is defined as the swing value L=|L4−L3|.

From the above Table, it can be seen that the correspondence of the range of the height difference H1 relative to the eccentric distance a is (a, 2a). The correspondence of the range of the swing value L relative to the eccentric distance a is (3a, 5a).

Figure 11:
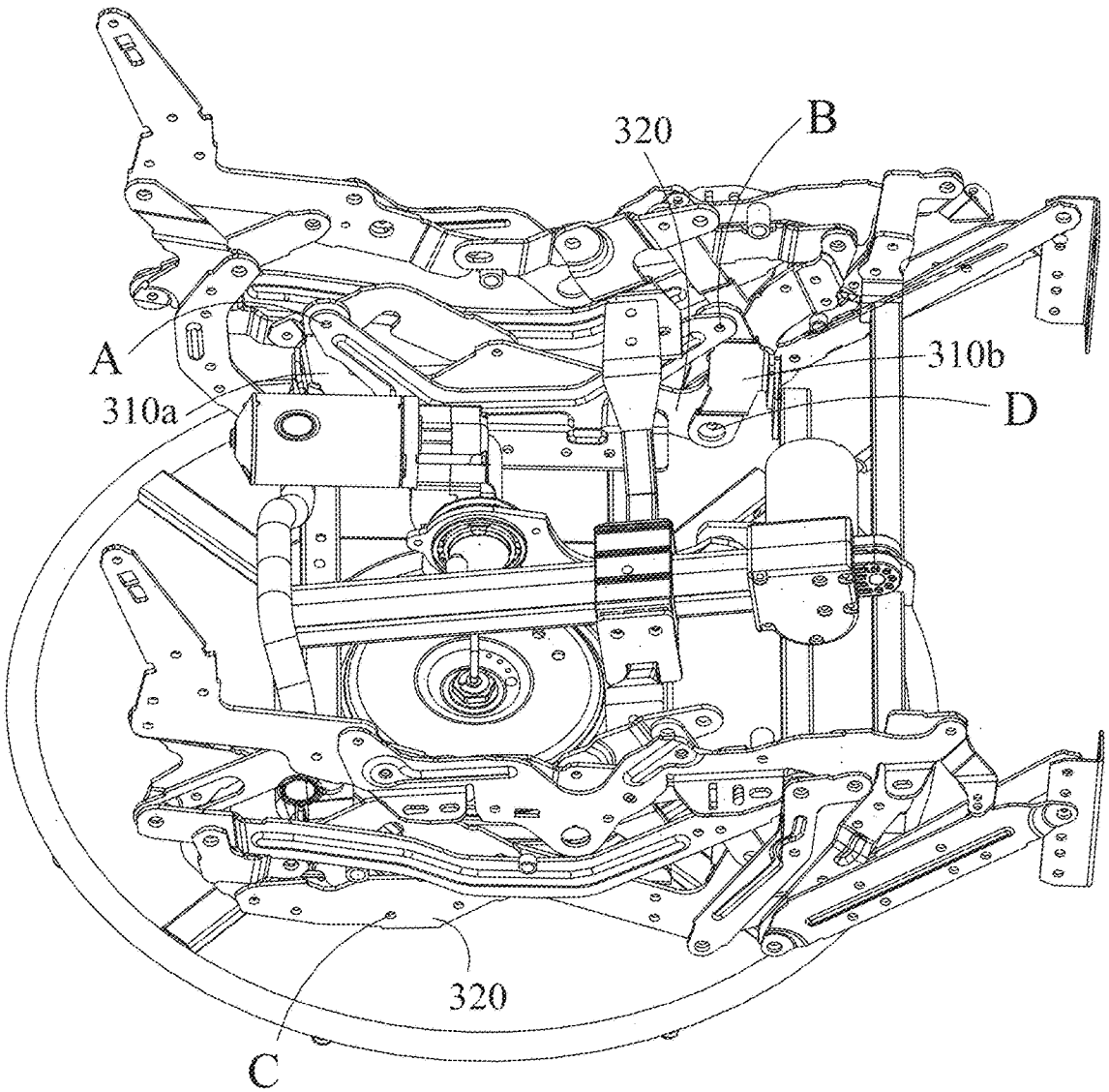
FIG. 11 is a structural schematic diagram illustrating another implementation of a swing mechanism according to an embodiment of the present disclosure.

With reference to FIGS. 1 to 4, at least one embodiment provides a swing mechanism, which specifically further includes the pedestal; the swing support frame 200 is located on the pedestal and includes the left support sheet 210*a* and the right support sheet 210*b*. Both ends of an upper part of the left support sheet 210*a* and the right support sheet 210*b* are symmetrically provided with the suspension point A and the suspension point B. The two iron frame bearing frames 300 each include the first rocking arm 310*a* and the second rocking arm 310*b*. Upper ends of the first rocking arm 310*a* and the second rocking arm 310*b* are respectively hinged to the suspension point A and the suspension point B of the corresponding support sheet, and lower ends of the first rocking arm 310*a* and the second rocking arm 310*b* are respectively hinged to the hinging position C and the hinging position D of the corresponding bearing piece 320. The swing angle of the first rocking arm 310*a* is 10° to 55°. A straight line distance between the suspension point A and the suspension point B is L1, and a straight line distance between the hinging position C and the hinging position D is L2, where L1:L2=(240 mm to 260 mm):(200 mm to 240 mm). In this embodiment, the bearing pieces 320 can be implemented by using connection rods at the bottom of the iron frame left sheet 400*a* and the iron frame right sheet 400*b* in FIG. 11, and which the bearing pieces 320 belongs to is not limited in this embodiment. FIG. 11 is a structural schematic diagram illustrating another implementation of a swing mechanism according to an embodiment of the present disclosure. The bearing pieces 320 may also be a part of the bottom of the recliner iron frame. Therefore, in some embodiments, whether the bearing pieces 320 in the above swing mechanism belong to the recliner iron frame does not hinder the implementation of the swing mechanism.

With reference to FIGS. 1 to 4, at least one embodiment further provides a swing mechanism, which specifically further includes the left support sheet 210*a* and the right support sheet 210*b*. Both ends of an upper part of the left support sheet 210*a* and the right support sheet 210*b* are provided respectively with the suspension point A and the suspension point B. The first rocking arm 310*a* and the second rocking arm 210*b* correspond to the support sheet and their upper ends are respectively hinged to the suspension point A and the suspension point B, and their lower ends are respectively hinged to the hinging position C and the hinging position D of the corresponding bearing piece 320. The straight line distance between the suspension point A and the suspension point Bis L1, the straight line distance between the hinging position C and the hinging position D is L2, and L1:L2=(240 mm to 260 mm):(200 mm to 240 mm). The drive mechanism 500 is further included to drive the first and second rocking arms to synchronously swing, where the swing angle of the first rocking arm is 10° to 55°. In this embodiment, the bearing pieces 320 can be implemented by using connection rods at the bottom of the iron frame left sheet 400*a* and the iron frame right sheet 400*b* in FIG. 11, and which the bearing pieces 320 belong to is not limited herein.

The relevant parameter constraint condition of the approximate inverted trapezoidal structure formed by the suspension point A, the suspension point B, the hinging position C and the hinging position D can be referred to the descriptions of the above embodiments and will not be repeated herein.

In some embodiments, the specific implementation of the drive mechanism 500 can be referred to the above descriptions.

With reference to FIGS. 2 and 3, at least one embodiment further provides an electric recliner, which includes a swing mechanism and a recliner iron frame. The recliner iron frame is disposed on bearing pieces 320 and includes left and right sheets (e.g. iron frame left sheet 400*a* and iron frame right sheet 400*b*). Support ends of the iron frame left and right sheets are disposed on the corresponding bearing pieces.

In some embodiments, at least two support ends of each of the iron frame left and right sheets are respectively connected with a first iron frame connection position at a side of the hinging position C away from the leg side of the iron frame and a second iron frame connection position at a side of the hinging position D facing toward the back side of the iron frame.

With reference to FIG. 11, the bearing pieces 320 may also be a part of the bottom of the recliner iron frame. The bearing pieces 320 can be disposed independently as shown in FIGS. 1 to 10 or disposed integrally with the recliner iron frame as shown in FIG. 11.

Since the bearing pieces can be disposed independently or integrally with the recliner iron frame, the specific iron frame connection positions can be adjusted based on actual situations as long as the suspension point A, the suspension point B, the hinging position C and the hinging position D can form an approximate inverted trapezoid, with the bearing pieces 320 located at the lower part of the inverted trapezoid. In this way, the corresponding technical effects of the swing mechanism can be realized.

To sum up, in the swing mechanism and the electric recliner, an approximate inverted trapezoidal structure is formed by the suspension point A, the suspension point B, the hinging position C and the hinging position D to realize limitation on the back-forth swing distance and the up-down fluctuation distance. When an iron frame is mounted on the swing mechanism, the support positions at the bottom of the iron frame left and right sheets can correspond to the iron frame connection positions on the bearing pieces, so as to improve the mounting compatibility of the iron frame, achieving the same swing effect with different iron frames.

In the above discussions, unless otherwise stated, the terms "about", "around", "basically" and the like for descriptions of values represent the values can change within +/−10%.

In the present disclosure, when it is said that a first component is above a second component, it means the first component may be directly formed on the second component or a third component is interposed between the first and second components. Besides, in the drawings, for the purpose of effective descriptions of the technical contents, the thickness of the components may be overstated or understated.

In the present disclosure, when an element or layer is referred to as "located at", "engaged to", "connected to", "attached to" or "coupled to" another element or layer, such element or layer may be directly located at, engaged to, connected to, attached to or coupled to another element or layer or an intermediate element or layer is present therebetween. To the contrary, when one element is referred to as "directly above another element or layer", "directly engaged to", "directly connected to", "directly attached to" or "directly coupled to" another element or layer, there may be no intermediate element or layer. Other words for describing the relationship of the elements shall be interpreted in similar way (e.g. "between" corresponds to "directly between", and "adjacent" corresponds to "directly adjacent"

and the like). As used herein, the term "and/or" includes any and all combinations of one or more listed associated items.

In the present disclosure, exemplary embodiments of the present disclosure will be described in more details by referring to drawings. As used herein, when the expression, for example, "at least one of . . . " precedes a series of elements, it modifies the whole series of elements rather than modifies any individual element in the series. For example, the expression "at last one of a, b and c" shall be understood as including only a, only b, only c, both of a and b, both of a and c, both of b and c, or all of a, b and c.

The terms used herein are used only to describe particular exemplary configurations rather than to make any limitation. As used herein, the articles "a", "an" and "the" in singular forms can also be intended to include plural forms unless otherwise indicated clearly. The terms "include", "contain" and "have" are inclusive and therefore the presence of the specified features, steps, operations, elements and/or components does not preclude presence or addition of one or more other features, steps, operations, elements, components and/or their combinations.

Inspired by the above ideal embodiments of the present disclosure, those skilled in the arts may, with the above descriptions, make various variations and modifications without departing from the scope of the technical idea of the present disclosure. The technical scope of the present disclosure is not limited to the contents of the above specification but determined by the appended claims.

What is claimed is:

1. A swing mechanism, comprising:

a pedestal;

a swing support frame, located on the pedestal and comprising left and right support sheets, wherein both ends of an upper part of the left and right support sheets are respectively provided with a suspension point A and a suspension point B;

two iron frame bearing frames, respectively located at outer sides of the left and right support sheets and each comprising a first rocking arm and a second rocking arm; wherein upper ends of the first rocking arm and the second rocking arm are respectively hinged to the suspension point A and the suspension point B of the corresponding support sheet, and lower ends of the first rocking arm and the second rocking arm are respectively hinged to a hinging position C and a hinging position D of a corresponding bearing piece; and at least one first iron frame connection position at a side of the hinging position C away from a leg side of an iron frame is disposed on the bearing pieces, and at least one second iron frame connection position at a side of the hinging position D facing toward a back side of the iron frame is disposed on the bearing pieces;

wherein the swing mechanism further comprises:

a drive mechanism, wherein a drive end of the drive mechanism is hinged to a drive cross arm disposed between the two iron frame bearing frames to drive the bearing pieces to swing;

wherein the drive mechanism comprises a drive motor, a crank arm and an eccentric wheel; wherein a first end of the crank arm serves as the drive end, and a second end of the crank arm is rotatably connected with a drive shaft of the drive motor via the eccentric wheel; and an eccentric distance of the eccentric wheel is positively correlated with a swing amplitude of the bearing pieces.

2. The swing mechanism according to claim 1, wherein a swing angle of the first rocking arm is 10° to 55°; and a straight line distance between the suspension point A and the suspension point B is L1, a straight line distance between the hinging position C and the hinging position D is L2, and L1:L2=(12 to 13):(10 to 12).

3. The swing mechanism according to claim 1, wherein when the bearing piece swings, the first rocking arm swings toward the leg side of the iron frame, and a maximum included angle between a line connecting the hinging position C and the hinging position D and a horizontal plane is $\alpha 1$;

when the first rocking arm swings to the back side of the iron frame, the maximum included angle between the line connecting the hinging position C and the hinging position D and the horizontal plane is $\alpha 2$; and a straight line distance of the hinging position C and the hinging position D is L2;

wherein $\alpha 1$:$\alpha 2$:L2=(1° to −4°):(2° to 6°):(200 mm to 240 mm).

4. The swing mechanism according to claim 1, wherein a straight line distance between the suspension point A and the suspension point B is L1, a straight line distance between the hinging position C and the hinging position D is L2, and L1:L2=(240 to 260):(200 to 240); and when the bearing piece swings, a height difference of a highest level and a lowest level of the hinging position C is H1;

wherein L1:L2:H1=(240 to 260):(200 to 240):(2 to 25).

5. The swing mechanism according to claim 1, wherein a straight line distance between the suspension point A and the suspension point B is L1, a straight line distance between the hinging position C and the hinging position D is L2, and L1:L2=(240 to 260):(200 to 240); and when the bearing piece swings, a back-forth swing value of the hinging position C is L;

wherein L1:L2:L=(240 to 260):(200 to 240):(8 to 85).

6. The swing mechanism according to claim 1, wherein a straight line distance between the suspension point A and the suspension point B is L1, a straight line distance between the hinging position C and the hinging position D is L2; and the suspension point A is approximate in height to the suspension point B; and when the bearing piece is in a natural suspension state, a vertical distance of the suspension point A or the suspension point B from a line connecting the hinging position C and the hinging position D is H;

wherein L1:L2:H=(240 to 260):(200 to 240):(83 to 120).

7. The swing mechanism according to claim 1, wherein the eccentric distance is a;

when the bearing piece swings, a height difference of a highest level and a lowest level of the hinging position C is H1;

wherein a:H1=1:(1 to 2).

8. The swing mechanism according to claim 1, wherein the eccentric distance is a;

when the bearing piece swings, a back-forth swing value of the hinging position C is L;

wherein a:L=1:(3 to 5).

9. A swing mechanism, comprising:

a pedestal;

a swing support frame, located on the pedestal and comprising left and right support sheets, wherein both ends of an upper part of the left and right support sheets are respectively provided with a suspension point A and a suspension point B;

two iron frame bearing frames, respectively located at outer sides of the left and right support sheets and each comprising a first rocking arm and a second rocking arm; wherein upper ends of the first rocking arm and the second rocking arm are respectively hinged to the suspension point A and the suspension point B of the corresponding support sheet, and lower ends of the first rocking arm and the second rocking arm are respectively hinged to a hinging position C and a hinging position D of a corresponding bearing piece; and a swing angle of the first rocking arm is 10° to 55°; and a straight line distance between the suspension point A and the suspension point B is L1, a straight line distance between the hinging position C and the hinging position D is L2, and L1:L2=(240 mm to 260 mm):(200 mm to 240 mm);

wherein the bearing pieces are driven to swing by a first drive mechanism; wherein the first drive mechanism comprises a drive motor, a crank arm and an eccentric wheel; wherein a first end of the crank arm serves as a drive end and a second end of the crank arm is rotatably connected with a drive shaft of the drive motor via the eccentric wheel; and an eccentric distance of the eccentric wheel is positively correlated with a swing amplitude of the bearing pieces; or the bearing pieces are driven to swing by a second drive mechanism, wherein the second drive mechanism is a linear driver, and an extension end of the linear driver serves as the drive end;

a telescoping distance of the linear driver adjusts the swing angle of the corresponding first rocking arm to be 10° to 55°.

10. The swing mechanism according to claim 9, wherein when the bearing piece swings, the first rocking arm swings toward a leg side of an iron frame, and a maximum included angle between a line connecting the hinging position C and the hinging position D and a horizontal plane is $\alpha 1$;

when the first rocking arm swings to a back side of the iron frame, the maximum included angle between the line connecting the hinging position C and the hinging position D and the horizontal plane is $\alpha 2$;

when the bearing piece swings, a height difference of a highest level and a lowest level of the hinging position C is H1;

when the bearing piece swings, a back-forth swing value of the hinging position C is L;

the suspension point A is approximate in height to the suspension point B; and when the bearing piece is in a natural suspension state, a vertical distance of the suspension point A or the suspension point B from a line connecting the hinging position C and the hinging position D is H;

wherein $\alpha 1:\alpha 2:L2$=(1° to −4°):(2° to 6°):(200 mm to 240 mm);

or L1:L2:H1=(240 mm to 260 mm):(200 mm to 240 mm):(2 mm to 25 mm);

or L1:L2:L=(240 mm to 260 mm):(200 mm to 240 mm):(8 mm to 85 mm);

or L1:L2:H=(240 mm to 260 mm):(200 mm to 240 mm):(83 mm to 120 mm).

11. An electric recliner, comprising the swing mechanism according to claim 1, and a recliner iron frame, disposed on the bearing pieces, and comprising iron frame left and right sheets, wherein support ends of the iron frame left and right sheets are respectively disposed on the corresponding bearing pieces.

* * * * *